US006419112B1

(12) United States Patent
Bruce et al.

(10) Patent No.: US 6,419,112 B1
(45) Date of Patent: Jul. 16, 2002

(54) SPILL RESISTANT LID

(75) Inventors: Robert Bruce, Buchanan; Robert C. Warrer, Paris, both of TN (US); Herbert B. Farmer, Salt Lake City, UT (US)

(73) Assignee: Farmarte, LLC, Salt Lake City, UT (US)

( * ) Notice: Subject to any disclaimer, the term of this patent is extended or adjusted under 35 U.S.C. 154(b) by 0 days.

(21) Appl. No.: 09/585,689

(22) Filed: Jun. 1, 2000

(51) Int. Cl.[7] ..... B65D 41/18; A47G 19/22

(52) U.S. Cl. ..... 220/781; 220/792; 220/711; 220/717; 206/509

(58) Field of Search ..... 220/780–782, 220/790, 792, 796, 802, 380, 703, 711, 713, 716, 717, 719; 206/508, 509, 511

(56) References Cited

U.S. PATENT DOCUMENTS 3,307,739 A * 3/1967 Cloyd et al.
3,384,265 A * 5/1968 Frank
3,557,995 A * 1/1971 Mirasol, Jr.
3,598,271 A * 8/1971 Holley
3,805,991 A * 4/1974 Cheladze et al.
3,860,162 A * 1/1975 Schutz
3,868,043 A * 2/1975 Freemyer
4,210,256 A 7/1980 Amberg et al.
4,350,260 A 9/1982 Prueher
4,441,623 A 4/1984 Antoniak
4,503,992 A 3/1985 Sitko et al.
4,589,569 A * 5/1986 Clements ..... 220/380
4,627,537 A * 12/1986 Rogers ..... 206/508
4,756,440 A * 7/1988 Gartner
4,986,437 A 1/1991 Farmer
5,253,781 A * 10/1993 Van Melle et al. ..... 220/713
5,538,157 A * 7/1996 Proshan ..... 220/713
5,624,053 A * 4/1997 Freek et al. ..... 220/713

* cited by examiner

*Primary Examiner*—Nathan J. Newhouse
(74) *Attorney, Agent, or Firm*—Mallinckrodt & Mallinckrodt; Robert R. Mallinckrodt

(57) ABSTRACT

A spill resistant lid includes a sealing bead in pressure contact with the inside wall of a container to be closed when the lid is in sealing position with respect to the container to substantially seal the container. The lid includes a first cylindrical wall and a second cylindrical wall spaced apart to form a receiving channel for the top of a container to be sealed. A ridge extends into the channel from the first cylindrical wall to hold the lid in place. The sealing bead extends into the channel from the second cylindrical wall. A central lid portion closes the area inside the second cylindrical wall and applies sealing pressure to the bead. In a preferred embodiment a third cylindrical wall in the central lid portion is joined to the second cylindrical wall by a web. The relative positions of the second cylindrical wall, the web, and the third cylindrical wall are deformed when the lid is in sealing position on the container and such deformation causes the bead to apply sealing pressure to the inside container wall. The central lid portion also preferably includes a container bottom platform and container receiving groove or secondary container platform for receiving and holding the bottom of a container stacked on the lid.

20 Claims, 3 Drawing Sheets

SPILL RESISTANT LID

BACKGROUND OF THE INVENTION

1. Field

Figure 2:
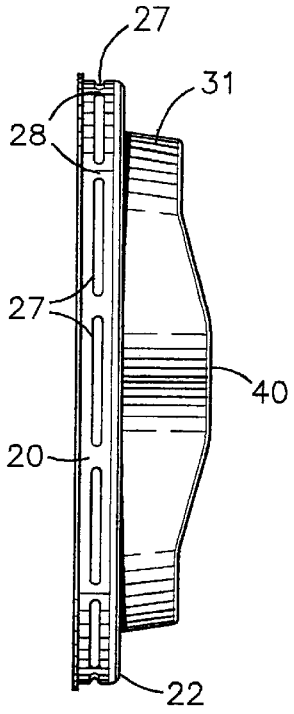

The invention is in the field of spill resistant lids or caps for containers such as beverage cups or glasses.

2. State of the Art

There are various lids or caps currently available to be placed on beverage cups or glasses to help prevent spillage of the beverage contained therein. A common type of lid is a disposable lid made of thin plastic material which is snapped onto the top of paper or plastic soft drink or hot drink cups at fast food restaurants. Examples of these are as shown in my issued U.S. Pat. No. 4,986,437 and in patents such as U.S. Pat. Nos. 4,986,437 and 4,503,992. However, while many of these lids do a relatively good job of preventing spills, there is always room for improvement in the areas of preventing leakage to thereby prevent drips and spills, and in the area of retention of the lid on the top of the container. Leakage caused by liquid seeping around the top of the container because of poor sealing of the lid to the container remains a problem and causes spills due to drips. Also, improvement can be made in the stackability of containers using such lids.

SUMMARY OF THE INVENTION

According to the invention, a spill resistant lid for sealing the open top of a container includes a first cylindrical wall and a second cylindrical wall secured to the first cylindrical wall and spaced therefrom to form a receiving channel for the open top of a container to be received therein. A ridge extends inwardly from the first cylindrical wall into the receiving channel. The first cylindrical wall and ridge extending therefrom cooperate to deform to allow the wall and ridge to move outwardly to allow a bead about the top outside edge of the container to move into the receiving channel and the wall and ridge to move back so that the ridge contacts the outside wall of the container below the bead to secure and hold the lid over the top of the container. The ridge can be continuous or can be discontinuous. A discontinuous ridge is presently preferred to lessen the collapsability of the ridge and the first cylindrical wall. An inner continuous bead extends outwardly from the second cylindrical wall into the receiving channel. The outside diameter of the bead is greater than the inside diameter of the container opening at the location of the inner continuous bead when the lid is in sealing position over the container opening so the bead exerts sealing pressure against the inside wall of the container. A central lid portion is secured to the second cylindrical wall to fill in and close the area inside the second cylindrical wall. The central lid portion deforms and cooperates with the second cylindrical wall and inner continuous bead extending therefrom to create the sealing force on the inner continuous ridge against the inner wall of the container.

The central lid portion preferably includes a third cylindrical wall which forms a reservoir area in the central lid portion and a drinking opening for discharge of liquid through the opening to allow a user to drink from the container with the lid in position on the container. The third cylindrical wall is secured to the second cylindrical wall by a web, the web position and orientation with respect to the second and third cylindrical walls being deformable to allow the inner continuous bead to move inwardly along the inside wall of the container as the top of the container is inserted into the receiving channel and to apply sealing force against the inside wall of the container when in sealing position on the container. It is presently preferred that the web be configured to be displaced downwardly when the lid is placed in sealing position over the open topped container. With such orientation, when the lid is placed over the open topped container and pressure is applied to the central lid portion, such as by applying such pressure to the third cylindrical wall, the web will be displaced downwardly by the pressure applied to the third cylindrical wall which will pull the inner bead inwardly and facilitate moving the lid to sealing position with respect to the container. When the downward pressure is released from the third cylindrical wall, the web moves back toward its original orientation and applies pressure to the second cylindrical wall and to the inner bead so the inner bead applies sealing pressure against the inner wall of the container.

The central lid portion may also include a container bottom platform so that a portion of the bottom of another container to be stacked on the container with the lid may be received thereon and the lid may also include one or more container bottom receiving grooves to receive another portion of the bottom of the container to be stacked to hold the stacked container in position on the lid. When stacked, a portion of the bottom of the container will be received in a groove and another portion, generally the opposite portion, will rest on the container bottom platform. Rather than a bottom receiving groove, a secondary container bottom platform may be provided to receive a portion of the bottom of the container to be stacked. The container bottom platform and groove or secondary platform are configured to be at substantially the same height so that a container stacked thereon is held substantially level when the lower container on which it is stacked is substantially level. The platforms or platform and groove are sized and configured so that walls hold the stacked container received therein from sliding on the lid.

The central lid portion and third cylindrical wall will preferably form a reservoir to hold and funnel back into the container any liquid that may escape from a drinking hole or opening in the lid. The drinking hole is preferably located inside the third cylindrical wall in the reservoir formed thereby. The drinking hole may extend through the container bottom platform or through a beveled portion extending to the third cylindrical wall. The third cylindrical wall may also include a spout aligned with the drinking hole to help the user align his or her mouth with the hole. The hole may be elliptical in shape and oriented radially lengthwise.

THE DRAWINGS

Figure 1:
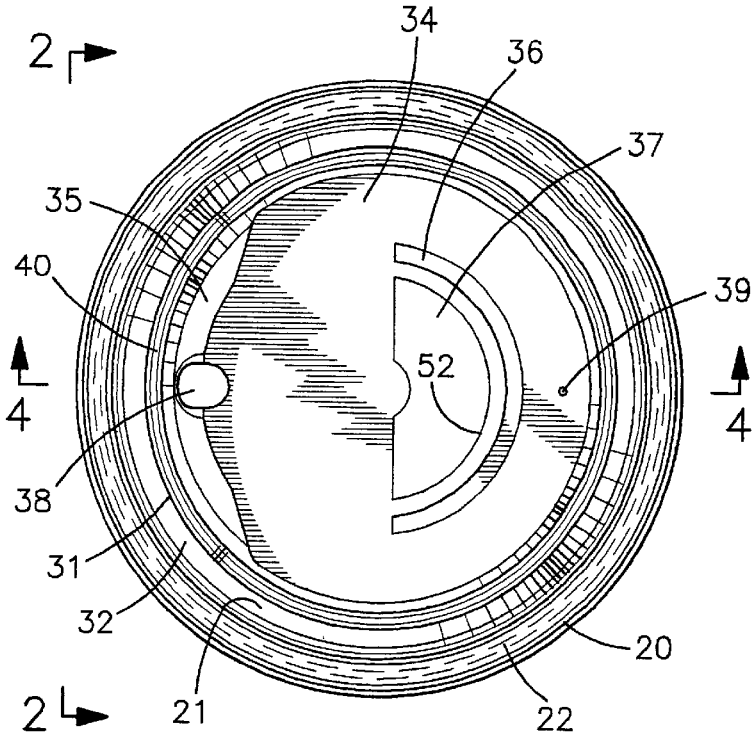
Figure 3:
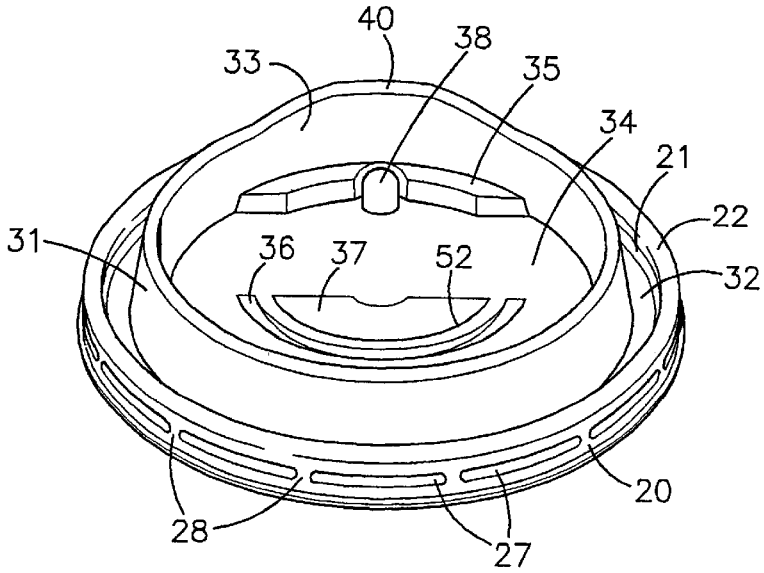
Figure 4:
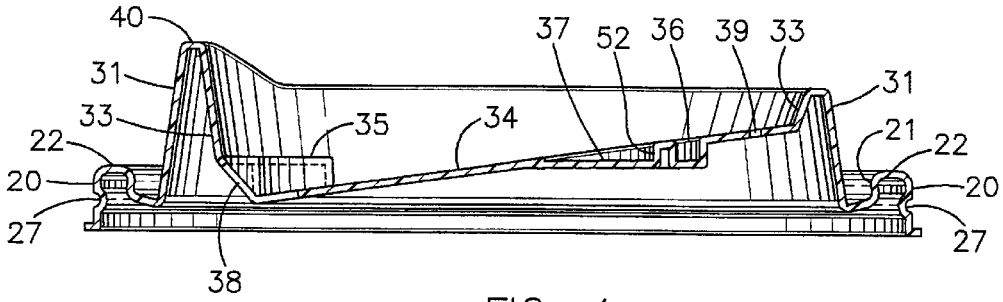
Figure 10:
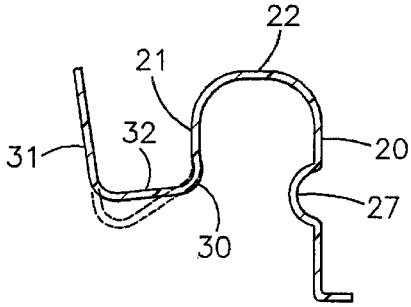
Figure 9:
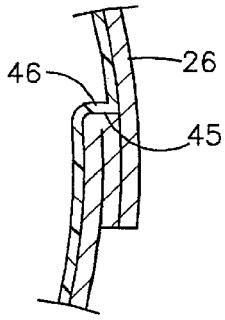
Figure 5:
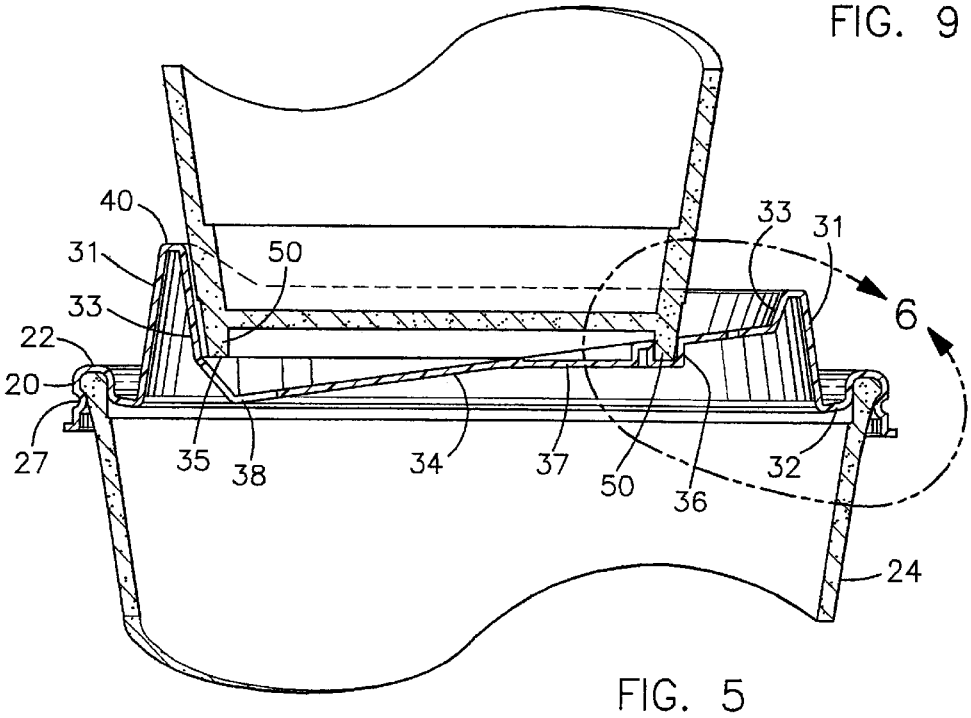
Figure 6:
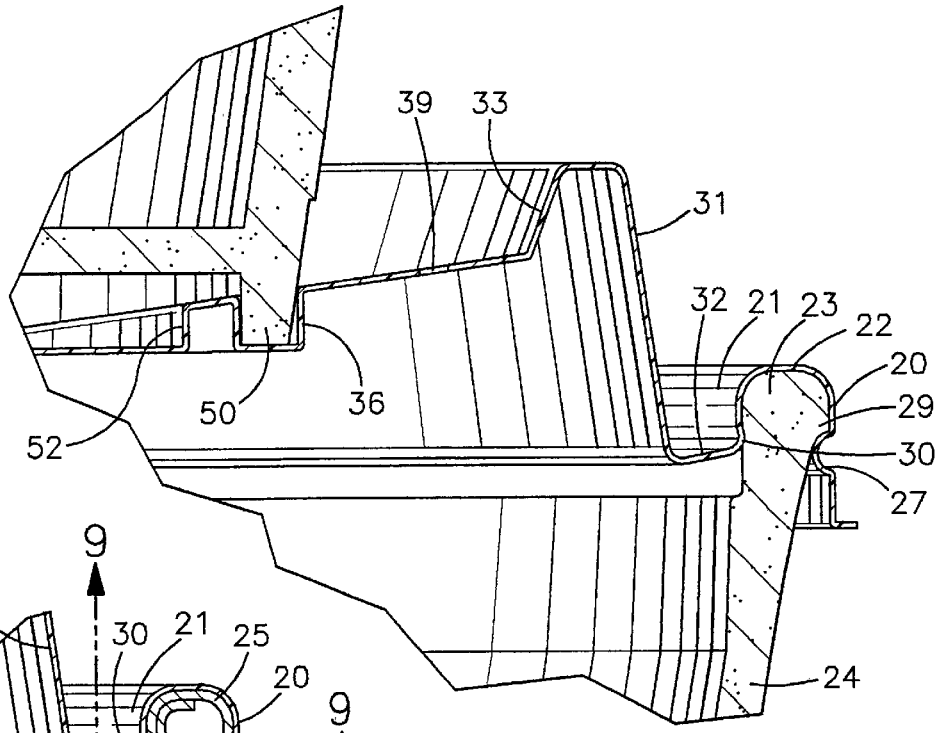
Figure 8:
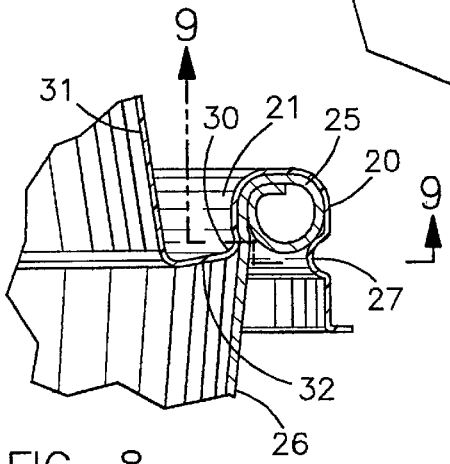
Figure 7:
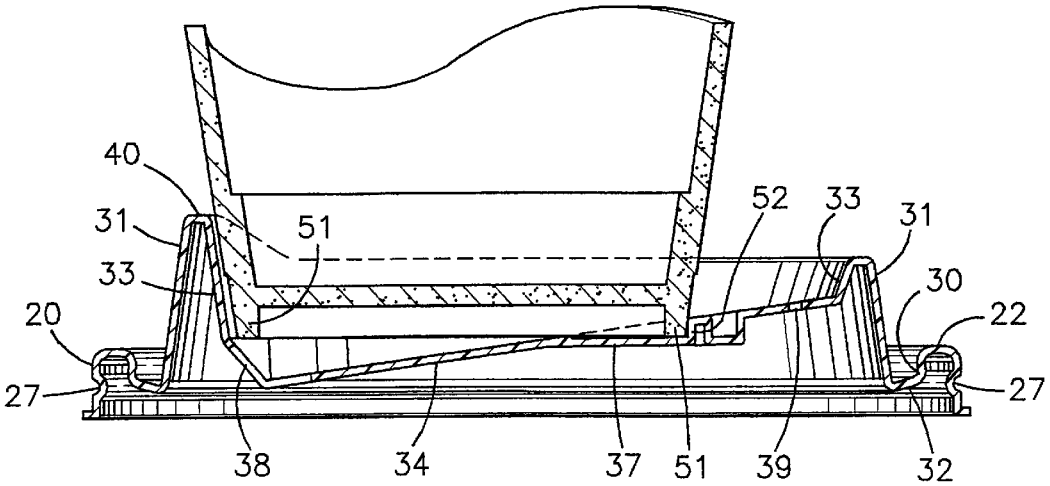

The best mode presently contemplated for carrying out the invention is illustrated in the accompanying drawings in which:

FIG. 1 is a top plan view of a lid of the invention;

FIG. 2, a front elevation of the lid taken on the line 2—2 of FIG. 1;

FIG. 3, a perspective rear and top view of the lid of FIGS. 1 and 2;

FIG. 4, a vertical section taken through the lid of FIG. 1 on the line 4—4;

FIG. 5, a view similar to that of FIG. 4, showing the lid mounted on a foam cup with a second cup stacked on the lid;

FIG. 6, an enlarged view of the portion of the lid and cup shown encircled by the line 6 in FIG. 5;

FIG. 7, a view similar to that of FIG. 5, but showing a smaller bottomed cup stacked on the lid, and not showing the container to which the lid is secured;

FIG. 8, a fragmentary vertical section of a portion of a lid showing the lid mounted on a paper cup having a rolled top;

FIG. 9, a fragmentary transverse section through a portion of the lid of FIG. 8 taken on a line such as 9—9 in FIG. 8, but showing a paper cup seam; and FIG. 10, a fragmentary vertical section through an edge portion of a lid of the invention not mounted on a container and showing the normal position and orientation of the web with respect to the second and third cylindrical wall when not mounted on a container in solid lines and a displaced position occurring when the inner bead is displaced, as when mounted on a container, in broken lines.

DETAILED DESCRIPTION OF THE ILLUSTRATED EMBODIMENT

The invention provides a lid for open topped containers such as foam cups and paper cups which has improved sealing and holding characteristics when placed in sealing position over the open top of a container. Improved sealing is provided by a continuous inner bead which applies sealing pressure against the inner wall of the container. As shown in the drawings, a presently preferred embodiment of the invention includes a first cylindrical wall 20 and a second cylindrical wall 21. The first and second cylindrical walls 20 and 21 are joined at their tops by top connecting wall 22 so as to form a receiving channel for the top of a container, such as top 23 of a foam cup container 24, FIGS. 5–7, or a roll top 25 of a paper cup container 26, FIG. 8. A ridge 27 extends inwardly from wall 20 into the receiving channel and may be continuous or discontinuous as shown in FIGS. 1–7. The discontinuous ridge 27 is presently preferred because the areas 28 between the discontinuous ridge portions reinforce the first cylindrical wall so it resists collapsing along the ridge as it is forced onto the top of the container. Generally the containers to be topped with a lid have a rim or lip 29 extending around the top of the outside wall of the container. Such rim or lip 29 is generally molded into the container as in a foam cup, FIGS. 5–7, or formed by the roll 25 of the cup material as in paper cups, FIG. 8. Some containers are merely tapered at their top so the outside edge forms a rim extending outwardly further than the outside wall below the top. The first cylindrical wall 20 and ridge 27, as well as top connecting wall 22, cooperate to allow wall 20 and ridge 27 to move outwardly to enlarge the receiving channel when the lid is pushed onto the top of the container so that ridge 27 will move out and over the top outside wall of the container, including lip 29 if present on the container, and move back against the outside wall below the top and lip to hold the lid on the container. Such movement is caused by ridge 27 following the contour of the top of the container, including any lip present, as it is being pushed into sealing position over the top of the container. It should be realized, however, that the ridge does not have to contact the outside wall of the container below the top but merely move inwardly toward the outside wall of the container so that it is below the lip or top rim of the container to hold the lid on the container.

A bead 30 extends from the second cylindrical wall 21 outwardly into the receiving channel and contacts and exerts sealing pressure on the inside wall of the container when the lid is in sealing position on the container. The bead 30 forms a line contact against and around the inside wall of the container substantially deforming to the irregularities of the inside wall.

The area inside the second cylindrical wall is closed by a central lid portion of the lid. This central lid portion may take various forms from a substantially flat surface secured to and filling the area inside the second cylindrical wall to various configurations providing additional walls, reservoirs, drinking holes, etc. As shown, a third cylindrical wall 31 is secured at its bottom to the bottom of the second cylindrical wall 21 by web 32. A fourth cylindrical wall 33 is attached to the top of the third cylindrical wall and extends downwardly with a sloped closure 34 inside thereof to form a reservoir. A container bottom platform 35 and one or more container bottom receiving grooves 36 and/or secondary container bottom platforms 37 are provided to allow containers to be stacked with the bottom of one container fitting into the lid of the container beneath.

If, as is common, the lid is used during drinking of a beverage from the container, a discharge opening or drinking hole 38 for allowing liquid to be discharged from the container and a vent opening 39 are provided in the central lid portion of the lid. It is presently preferred that these openings be provided in the reservoir portion of the central lid portion so any liquid unintentionally discharged from the openings will go into the reservoir and be funneled back into the container. A spout 40 may be formed by the third and fourth cylindrical walls in alignment with the discharge opening 38 to help the user align the discharge opening with the user's mouth when drinking, particularly when used under conditions, such as at night in a car, when it is difficult to see the position of the opening.

Various opening configuration may be used. The elliptical or oval opening arranged radially lengthwise of the lid is shown and has been found to work well.

The positioning and orientation of the central lid portion of the lid with respect to the second cylindrical wall and bead are such that the central lid portion is deformed when the lid is placed in sealing position on the container. This deformation results in sealing pressure being applied through the central lid portion and the second cylindrical wall to the bead so that the bead applies sealing pressure to the inside wall of the container. In the embodiment shown, the positioning and orientation of the web 32 in respect to the second cylindrical wall 21 and the third cylindrical wall 31 is such that the positioning and orientation deform or change as the lid is placed on the container so that such sealing pressure is applied. In the presently preferred positioning and orientation as shown, see particularly FIG. 10, web 32 is substantially horizontal or slightly sloped downwardly from the second to the third cylindrical walls in its normal rest position when not on a container so as the lid is placed on the container, second cylindrical wall 21 is pushed inwardly by the inside surface of the container wall and the positioning and orientation of web 32 in respect to the second and third cylindrical walls changes as web 32 takes on more of a downward slope between the walls as shown in broken lines in FIG. 10. The solid lines in FIG. 10 show the normal rest position of the web and walls of the lid.

The downward arrangement of web 32 is preferred because when downward pressure is put on the third cylindrical wall as when pushing downwardly on such wall to push the lid into sealing position over the top of the container, as seen in FIG. 10 in broken lines, the bead 30 is pulled inwardly to lessen the pressure exerted by the bead against the container inside wall easing placement of the lid in sealing position over the open top of the container. If web 32 sloped upwardly from the second to the third walls, downward pressure on the third wall when placing the lid on the container would tend to push the bead outwardly against the wall, rather than inwardly away from the wall, which would increase the bead pressure on the inside container wall when positioning the lid making it much harder to position the lid.

A particular problem with current container lids when used with paper cups is that they do not seal at the step seam 45, FIG. 9, where the two edges of the paper making the cup, such as paper cup 26 of FIG. 8, come together. This construction forming a step is typical of paper cups. This step seam causes the lids to leak and liquid in the cups to drip around the lid at such steps and spill on a user drinking from the cup. With the bead contact of the invention which can deform under sealing pressure, the bead substantially conforms as at 46, FIG. 9, to the step formed by the seam at least to the extent necessary to substantially prevent dripping during drinking from the container. while FIG. 9 may be exaggerated, it has been found that a good seal over the step seam of a paper cup is formed by the lid of the invention. This is an important feature of the invention.

Most of the paper and plastic cups in use today have a bottom circumferential rim 50, FIGS. 5 and 6, and 51, FIG. 7. Also, in many instances, a person desires to stack two or more cups for carrying. It is thus desirable to be able to reliably stack cups with lids one on top of the other and to have the cups rest solidly on one another to resist falling off when carried. For this purpose, the container bottom platform 35 and the container bottom receiving groove 36 or secondary container bottom platform 37 are configured and sized to receive and hold cups anticipated to be stacked on the lid. Thus, as shown in FIG. 5, a portion of the bottom rim 50 sits on the container bottom platform 35 against fourth cylindrical wall 33, while an opposite portion of the bottom rim is received in bottom receiving groove 36. This holds the stacked cup securely on the lid. FIG. 7 shows a smaller cup stacked on the lid. With the smaller cup, a portion of the bottom rim 51 again rests on the container bottom platform 35 against fourth cylindrical wall 33, and the opposite bottom rim portion sits on the secondary container bottom platform 37 against wall 52. This holds the stacked cup relatively securely on the lid. It should be noted that container bottom platform 35 is at approximately the same height as the bottom of container bottom receiving groove 36 and of secondary container bottom platform 37 so that the stacked cup is held substantially level when stacked. The secondary container platform 37 could be in the form of one or more bottom receiving grooves, if desired. It should be further noted that flat bottomed containers without rims 50 or 51 can be easily accommodated by the container bottom platform 25 and secondary container bottom platform 37.

The arrangement shown with container bottom receiving groove 36 and secondary container bottom platform 37 allow two different size cups or containers to be stacked on the lid. Both sizes, as shown by FIGS. 5–7 are held against sliding on the lid by the receiving groove 36 or by wall 52 around secondary container bottom platform 37. The stacked cups are also substantially level when the bottom cup on which they are stacked is level. This allows the stacked cups to be easily handled and carried. The bottom receiving groove and platforms will generally be sized to accommodate cups the same as or similar to those for which the lids are sized and configured to seal. With the number of different cups and containers available today, various sizes of lids may be made, different sizes to fit different sizes and types of cups and other containers.

While certain placements of openings and walls are shown in the central lid portion of the lid, various arrangements of openings and walls can be used as desired. The discharge opening does not have to be in a reservoir arrangement and may be located as desired in the lid and a reservoir arrangement is not necessary.

Whereas this invention is here illustrated and described with reference to embodiments thereof presently contemplated as the best mode of carrying out the invention in actual practice, it should be realized that various changes may be made in adapting the invention to different embodiments without departing from the broader inventive concepts disclosed herein and comprehended by the claims that follow.

What is claimed is:

1. A spill resistant lid adapted to be removably and sealably attached to an open topped container having an outside wall and an inside wall with the inside wall forming an inside diameter of the container, comprising:

a first cylindrical wall;

a second cylindrical wall spaced inwardly from and connected to the first cylindrical wall to form a channel therebetween to receive the open top of said container;

a ridge in the first cylindrical wall extending into the channel, said first cylindrical wall and ridge cooperating to allow the wall and ridge to move to enlarge the channel when the top of the container is inserted into the channel and the ridge to move inwardly toward the outside wall of the container when the lid is in sealing position over the top of the container;

an inner bead extending from the second cylindrical wall into the channel, said bead having a normal outside diameter larger than the inside diameter of the open container at a location along the inside wall of the container contacted by the inner bead when the lid is in sealing position over the top of the open container; and a central lid portion secured to the second cylindrical wall and closing the area inside the second cylindrical wall, said central lid portion including a third cylindrical wall and a web joining the third cylindrical wall to the second cylindrical wall, wherein the third cylindrical wall is displaced downwardly when the lid is placed in sealing position over the open topped container and the web is displaced at a downward angle with respect to the second cylindrical wall whereby sealing force is applied by the inner bead against the inside wall of the container when the lid is placed in sealing position over the open topped container.

2. A spill resistant lid according to claim 1, wherein the open topped container includes a lip around the top of the outside wall of the container, and the first cylindrical wall and ridge move under downward pressure applied to the lid with regard to the container to enlarge the channel when the top of the container with container lip is inserted into the channel and the ridge to move back toward the outside wall of the container below the lip when the lid is in sealing position over the top of the container, the interaction of the ridge and lip tending to secure the lid to the container over the open top of the container.

3. A spill resistant lid according to claim 1, wherein the central lid portion includes a discharge opening for discharge of liquid from the container so that a user can drink from the container with the lid in sealing position over the container.

4. A spill resistant lid according to claim 3, wherein the third cylindrical wall forms a reservoir.

5. A spill resistant lid according to claim 3, wherein the discharge opening is elliptical.

6. A spill resistant lid according to claim 5, wherein the elliptical discharge opening is arranged radially lengthwise in the lid.

7. A spill resistant lid adapted to be removably and sealably attached to an open topped container having an outside wall with a lip around the top of the outside wall and an inside wall with the inside wall forming an inside diameter of the container, comprising:

a first cylindrical wall;

a second cylindrical wall spaced inwardly from and connected to the first cylindrical wall to form a channel therebetween to receive the open top of said container;

a ridge in the first cylindrical wall extending into the channel, said first cylindrical wall and ridge cooperating to allow the first cylindrical wall and ridge to move under downward pressure applied to the lid with regard to the container to enlarge the channel when the top of the container with container lip is inserted into the channel and the ridge to move inwardly toward the outside wall of the container below the lip when the lid is in sealing position over the top of the container, the interaction of the ridge and lip tending to secure the lid to the container over the open top of the container;

an inner bead extending from the second cylindrical wall into the channel, said bead having a normal outside diameter larger than the inside diameter of the open container at a location along the inside wall of the container contacted by the inner bead when the lid is in sealing position over the top of the open container; and a central lid portion secured to the second cylindrical wall and closing the area inside the second cylindrical wall, said central lid portion including a third cylindrical wall and a web joining the third cylindrical wall to the second cylindrical wall, the web position and orientation with respect to the second and third cylindrical walls being deformable as the lid is placed in sealing position over the open topped container to allow the inner bead to move inwardly and the receiving channel to receive the top of the container and to apply sealing pressure of the inner bead against the inside wall of the container when the lid is placed in sealing position over the open topped container;

a discharge opening in the central lid portion for discharge of liquid from the container so that a user can drink from the container with the lid in sealing position over the container; and a spout aligned with the discharge opening to aid the user in aligning the discharge opening with the user's mouth.

8. A spill resistant lid according to claim 7, wherein the discharge opening is elliptical.

9. A spill resistant lid according to claim 8, wherein the elliptical discharge opening is arranged radially lengthwise in the lid.

10. A spill resistant lid according to claim 7, additionally including a container bottom platform in the central lid portion to receive a portion of a bottom of a container stacked on the lid and a container bottom receiving groove in the central lid portion to receive another portion of the bottom of the container stacked on the lid when a portion rests on the platform.

11. A spill resistant lid according to claim 10, additionally including a secondary container bottom platform to receive the another portion of the container bottom when the another portion of the container bottom is not received in the receiving groove, whether the another portion of the container bottom is received in the receiving groove or on the secondary receiving platform depending on the size of the container stacked on the lid.

12. A spill resistant lid according to claim 11, additionally including a container bottom platform in the central lid portion to receive a portion of a bottom of a container stacked on the lid and a secondary container bottom receiving platform in the central lid portion to receive another portion of the bottom of the container stacked on the lid when a portion rests on the platform.

13. A spill resistant lid adapted to be removably and sealably attached to an open topped container having an outside wall with a lip around the top of the outside wall and an inside wall with the inside e wall forming an inside diameter of the container, comprising:

a first cylindrical wall;

a second cylindrical wall spaced inwardly from and connected to the first cylindrical wall to form a channel therebetween to receive the open top of said container;

a ridge in the first cylindrical wall extending into the channel, said first cylindrical wall and ridge cooperating to allow the first cylindrical wall and ridge to move under downward pressure applied to the lid with regard to the container to enlarge the channel when the top of the container with container lip is inserted into the channel and the ridge to move inwardly toward the outside wall of the container below the lip when the lid is in sealing position over the top of the container, the interaction of the ridge and lip tending to secure the lid to the container over the open top of the container;

an inner bead extending from the second cylindrical wall into the channel, said bead having a normal outside diameter larger than the inside diameter of the open container at a location along the inside wall of the container contacted by the inner bead when the lid is in sealing position over the top of the open container; and a central lid portion secured to the second cylindrical wall and closing the area inside the second cylindrical wall, said central lid portion including a third cylindrical wall which forms a reservoir, and a web joining the third cylindrical wall to the second cylindrical wall, wherein the third cylindrical wall is displaced downwardly when the lid is placed in sealing position over the open topped container and the web is displaced at a downward angle with respect to the second cylindrical wall to allow the inner bead to apply sealing pressure against the inside wall of the container; and a discharge opening in the central lid portion for discharge of liquid from the container so that a user can drink from the container with the lid in sealing position over the container.

14. A spill resistant lid according to claim 13, wherein downward pressure applied to the central lid portion deforms the web downwardly and reduces sealing pressure of the bead against the inside wall of the container to ease placement of the lid in sealing position over the open top of the container.

15. A spill resistant lid according to claim 14, additionally including a container bottom platform in the central lid portion to receive a portion of a bottom of a container stacked on the lid and a secondary container bottom receiving platform in the central lid portion to receive another portion of the bottom of the container stacked on the lid when a portion rests on the platform.

16. A spill resistant lid according to claim 14, additionally including a container bottom platform in the central lid portion to receive a portion of a bottom of a container stacked on the lid and a container bottom receiving groove in the central lid portion to receive another portion of the bottom of the container stacked on the lid when a portion rests on the platform.

17. A spill resistant lid according to claim 16, additionally including a secondary container bottom platform to receive the another portion of the container bottom when the another portion of the container bottom is not received in the receiving groove, whether the another portion of the container bottom is received in the receiving groove or on the secondary receiving platform depending on the size of the container stacked on the lid.

18. A spill resistant lid adapted to be removably and sealably attached to an open topped container having an outside wall with a lip around the top of the outside wall and an inside wall with the inside wall forming an inside diameter of the container, comprising:

a first cylindrical wall;

a second cylindrical wall spaced inwardly from and connected to the first cylindrical wall to form a channel therebetween to receive the open top of said container;

a ridge in the first cylindrical wall extending into the channel, said first cylindrical wall and ridge cooperating to allow the first cylindrical wall and ridge to move under downward pressure applied to the lid with regard to the container to enlarge the channel when the top of the container with container lip is inserted into the channel and the ridge to move inwardly toward the outside wall of the container below the lip when the lid is in sealing position over the top of the container, the interaction of the ridge and lip tending to secure the lid to the container over the open top of the container;

an inner bead extending from the second cylindrical wall into the channel, said bead having a normal outside diameter larger than the inside diameter of the open container at a location along the inside wall of the container contacted by the inner bead when the lid is in sealing position over the top of the open container; and a central lid portion secured to the second cylindrical wall and closing the area inside the second cylindrical wall, said central lid portion including a third cylindrical wall joined to the second cylindrical wall by a web, the web position and orientation with respect to the second and third cylindrical walls being deformable to displace the web at a downward angle and the third cylindrical wall downwardly with respect to the second cylindrical wall as the lid is placed in sealing position over the open topped container to allow the bead to move inwardly and the receiving channel to receive the top of the container and to apply sealing pressure of the bead against the inside wall of the container when the lid is in sealing position over the open topped container, whereby downward pressure applied to the central lid portion deforms the web further downwardly and reduces sealing pressure of the bead against the inside wall of the container to ease placement of the lid in sealing position over the open top of the container.

19. A spill resistant lid adapted to be removably and sealably attached to an open topped container having an outside wall with a lip around the top of the outside wall and an inside wall with the inside wall forming an inside diameter of the container, comprising:

a first cylindrical wall;

a second cylindrical wall spaced inwardly from and connected to the first cylindrical wall to form a channel therebetween to receive the open top of said container;

a ridge in the first cylindrical wall extending into the channel, said first cylindrical wall and ridge cooperating to allow the first cylindrical wall and ridge to move under downward pressure applied to the lid with regard to the container to enlarge the channel when the top of the container with container lip is inserted into the channel and the ridge to move inwardly toward the outside wall of the container below the lip when the lid is in sealing position over the top of the container, the interaction of the ridge and lip tending to secure the lid to the container over the open top of the container;

an inner bead extending from the second cylindrical wall into the channel, said bead having a normal outside diameter larger than the inside diameter of the open container at a location along the inside wall of the container contacted by the inner bead when the lid is in sealing position over the top of the open container; and a central lid portion secured to the second cylindrical wall and closing the area inside the second cylindrical wall, said central lid portion including a third cylindrical wall and a web joining the third cylindrical wall to the second cylindrical wall, the web position and orientation with respect to the second and third cylindrical walls being deformable as the lid is placed in sealing position over the open topped container to allow the inner bead to move inwardly and the receiving channel to receive the top of the container and to apply sealing pressure of the inner bead against the inside wall of the container when the lid is placed in sealing position over the open topped container;

a discharge opening in the central lid portion for discharge of liquid from the container so that a user can drink from the container with the lid in sealing position over the container; and a container bottom platform in the central lid portion to receive a portion of a bottom of a container stacked on the lid and a container bottom receiving groove in the central lid portion to receive another portion of the bottom of the container stacked on the lid when a portion rests on the platform.

20. A spill resistant lid according to claim 19, additionally including a secondary container bottom platform to receive the another portion of the container bottom when the another portion of the container bottom is not received in the receiving groove, whether the another portion of the container bottom is received in the receiving groove or on the secondary receiving platform depending on the size of the container stacked on the lid.

* * * * *